US008028446B2

(12) United States Patent
Moran

(10) Patent No.: US 8,028,446 B2
(45) Date of Patent: Oct. 4, 2011

(54) COLOR CODED BEVERAGE CAP COLLECTION WITH PERMANENT PASSIVE INDICIA INDICATING BEVERAGE BOTTLE USER IDENTITIES

(76) Inventor: Margaret Moran, Nesconset, NY (US)

( * ) Notice: Subject to any disclaimer, the term of this patent is extended or adjusted under 35 U.S.C. 154(b) by 0 days.

(21) Appl. No.: 10/860,875

(22) Filed: Jun. 4, 2004

(65) Prior Publication Data

US 2004/0216341 A1 Nov. 4, 2004

Related U.S. Application Data

(62) Division of application No. 10/323,555, filed on Dec. 19, 2002, now Pat. No. 6,745,505.

(60) Provisional application No. 60/418,800, filed on Oct. 15, 2002.

(51) Int. Cl.
*G09F 3/00* (2006.01)
*B65D 73/00* (2006.01)

(52) U.S. Cl. ..... 40/311; 40/310; 215/230

(58) Field of Classification Search ..... 40/310, 40/311, 300; 215/230, 495.5; 206/459.5
See application file for complete search history.

(56) References Cited

U.S. PATENT DOCUMENTS

| | | | | |
|---|---|---|---|---|
| 3,354,564 | A * | 11/1967 | Falcone et al. | 40/658 |
| 3,976,629 | A * | 8/1976 | Hayward et al. | 526/202 |
| 4,195,059 | A * | 3/1980 | Whitcher et al. | 422/61 |
| 4,203,240 | A * | 5/1980 | Goodwin | 40/310 |
| 4,759,139 | A * | 7/1988 | Ricks | 40/638 |
| 4,941,573 | A * | 7/1990 | Fuerstman | 206/459.5 |
| 5,100,621 | A * | 3/1992 | Berke et al. | 422/61 |
| 6,086,702 | A * | 7/2000 | Rea | 156/247 |
| 6,615,517 | B2 * | 9/2003 | King | 40/324 |
| 6,745,505 | B2 * | 6/2004 | Moran | 40/311 |
| 2005/0205513 | A1 * | 9/2005 | Hidding | 215/246 |

* cited by examiner

*Primary Examiner* — Casandra Davis
(74) *Attorney, Agent, or Firm* — Alfred M. Walker; Harvey Lunenfeld

(57) ABSTRACT

A collection of beverage bottles includes respective color-coded beverage caps. The beverage caps have permanent passive non-verbal indicia indicating the identity of the user of an unencumbered beverage bottle without tangible surface-interfering customized or temporary identifiers, such as tangible surface interfering elements, including stick-on labels, customized beverage can lids, or modified surfaces of beverage containers. The color-coded bottle caps are used as the actual caps for conventional beverage bottles. The color-coded caps do not add cumulative indicia to the bottle caps, in additional to pre-existing indicia, such as brand name logos, on the bottle caps.

1 Claim, 4 Drawing Sheets

COLOR CODED BEVERAGE CAP COLLECTION WITH PERMANENT PASSIVE INDICIA INDICATING BEVERAGE BOTTLE USER IDENTITIES

RELATED APPLICATIONS:

This application is a divisional of application Ser. No. 10/323,555, filed Dec. 19, 2002, U.S. Pat. No. 6,745,505, which application is based upon provisional application No. 60/418,800 filed Oct. 15, 2002.

FIELD OF THE INVENTION

The present invention relates to a set of liquid beverage refreshment bottles, each bottle having identical contents therein. The bottles have respective caps, with each bottle cap bearing a different colored indicia indicative of the user of the beverage bottle.

BACKGROUND OF THE INVENTION

Heretofore the prior art has not presented a collection of color coded beverage bottles with bottle caps having permanent passive, non-verbal indicia indicating the identity of the user of each beverage bottle of a collection of beverage bottles all having identical contents therein. Nor does the prior art describe color-coded bottle caps which provide permanent cumulative indicia in additional to pre-existing indicia on the bottle caps.

For example, U.S. Pat. No. 6,322,242 of Lang describes a collection of caps for chemical containers, to identify the contents of the containers having the caps thereon. However, each container has a separate, distinct chemical, so the colors are used to differentiate the different contents in each of the containers.

In addition, U.S. Pat. No. 6,276,853 of Breidenbach and Mille discloses having color dots or rings on perfume bottles to identify the type of perfume therein. Similar to Lang '242, in Breidenbach '853 each perfume bottle has a separate, distinct perfume, so the colors are used to differentiate the different types of perfume in each of the containers.

Also, U.S. Pat. No. 5,544,766 of Dunn describes color-coded bottle rings for baby nippled bottles, to distinguish different types of fluids in a collection of baby bottles.

U.S. Pat. No. 4,347,804 of Villa-Real describes color-coded medicine dispenser bottles to differentiate the different types of medicine in each of the dispenser bottles.

Among other publications identifying the use of color-coding to separate out different contents from similar configured containers is that of "HSC:Re: Colour-Coded Plastic Bottle Caps", 2 page website, published in 2002, which discusses the need for separating flammable/combustible materials into containers with color-coded coded caps, as noted in the website www.hronline.com. Another publication entitled "Nalgene Travel Bottle Kit—Medium" at www.rei.com published as a one page website in 2002, describes an assortment of eight bottles with color coded caps for separating different toiletries and cosmetics into separate bottles when traveling. However the Nalgene Travel Bottle Kit merely uses colors to differentiate the different types of toiletries in each of the containers. It does not describe color-coded bottle caps for containers having identical liquids therein, wherein the color-coded caps are used for the consumer to associate a particular bottle with the consumer.

A further publication entitled "Nalgene 32 oz. Narrow Mouth Lexan Bottle" at www.gearshark.com published also as a two page website in 2002, describes a single drinking bottle with a colored cap, but does not describe a collection of beverage bottle caps having permanent passive coded indicia thereon selectively indicating the identity of a user of an unencumbered beverage bottle of a collection of beverage bottles, each having identical liquid contents therein.

In addition, a three page website publication of 2002 entitled "Translucent Colors For Water Rockets", at www.h20rocket.com describes coloring plastic bottles for producing spectacular visual effects of different bottle rockets, but not for identifying the users of bottles having identical liquid contents therein.

As for identifying the user of a liquid container, a number of patents describe tangible distinct elements, which tangibly encumber either the liquid container or the lid on top of the container.

For example, U.S. Pat. No. 6,082,030 of Kesselring discloses a tangible beverage can tab that includes the user's name to identify the drinker of a beverage at a party. It is not a bottle cap but it helps drinkers of beverages identify whose beverage can belongs to whom. However, in Kesselring '030, the tangible tab must be separately affixed to the lid of the beverage can, encumbering it with a three dimensional object interfering with the smooth top lid of the beverage can.

Moreover, U.S. Pat. Nos. 5,301,802 and 5,191,979, both of Nemeroff describes a collection of individual drinking cups which have identifying indicia printed on them, such as the same of the user or a number attributed to a user, to facilitate visual identification of the user. The cups are called "Memory Cups". However in Nemeroff '802 and Nemeroff '979, there is a need to imprint the entire beverage container. Each container cup of Nemeroff '804 and Nemeroff '979 has to be separately printed. If Nemeroff were applied to beverage bottles with twist-off caps, the company's logo on the bottle's label or outer surface has to be separately printed, a task, which is unworkable.

Furthermore, in Nemeroff '804 and Nemeroff '979 the drinking container cups lack caps which could have been permanently and passively imprinted with colors to assist in identifying the user of each beverage bottle.

Other tangible identifying objects, which encumber beverage bottles, include cumbersome collars disclosed in U.S. Pat. No. 6,293,034 of Skapyak, which describes decorative collars having distinct decorative charms and trinkets. The collars go over wineglasses to identify the drinker thereof.

While the Nemeroff '804 and Nemeroff '979, Skapyak '034 and Kesselring '030 patents are for beverage cans, wine glasses and drinking cups, not beverage bottles, U.S. Pat. No. 6,086,702 of Rea discloses a beverage bottle which has removable adhesively stick-on labels to identify the user of the beverage bottle.

However in Rea '702 the stick-on labels must be separately adhered to the actual bottles, interfering with the surfaces thereof, leaving the possibility of adhesive residue on the surfaces of the bottles.

Other relevant patents include U.S. Pat. Nos. 5,704,144 of Groth for a tangible customized identification ring to go around a beverage can to identify the drinker of the can, U.S. Pat. No. 4,759,139 of Ricks for a tangible identifying collar for a baby bottle, U.S. Pat. No. 2,976,629 of Brixius for a tangible collar ring for a beverage bottle to identify the drinker of the liquid therein and U.S. Pat. No. 1,971,528 of Klebanow for a tangible collar ring around a milk bottle. U.S. Pat. No. 4,852,763 of Diberio describes separate, reusable color-coded notched beverage can lids that can identify the drinkers of the beverage can, to avoid contamination. However, the tangible notched lids of Tiberio do not come with the beverage cans as their primary lid.

OBJECTS OF THE INVENTION

Therefore, it is an object of the present invention to provide color-coded bottle caps for a collection of liquid dispensing bottles having a colored indicia indicative of the user of each of the bottles of identical beverages within each respective beverage bottle.

It is another object of the present invention to provide a color-coded beverage cap collection with permanent passive non-verbal cumulative indicia indicating the identity of the user of an unencumbered beverage bottle.

It is yet another object of the present invention to provide color-coded bottle caps in different colors to differentiate the drinking users of the identical liquids therein.

It is another object of the present invention to improve over the disadvantages of the prior art.

SUMMARY OF THE INVENTION

In keeping with these objects and others which may become apparent, the present invention includes a color coded beverage cap collection with permanent passive non-verbal temporally cumulative indicia thereon, bearing a single unadorned colored surface, which selectably indicates the identity of the user of an unencumbered beverage bottle, provided in a collection of beverage bottles, each having identical liquid contents therein.

The collection of beverage bottles, with color coded beverage caps having permanent passive non-verbal indicia thereon indicating the identity of the user of an unencumbered beverage bottle, obtains beneficial results, such as the ease of identifying users without tangible surface-interfering customized identifiers.

In addition, the present invention does not require tangible surface interfering elements, such as stick-on labels or customized beverage can lids, or the need to imprint the entire beverage container as in the Nemeroff drinking cups, wherein each cup has to be separately printed.

Instead, in the present invention, the color-coded bottle caps are used as the actual caps for conventional beverage bottles, such as those of PERRIER, EVIAN, POLAND SPRINGS or COCA-COLA.

The color-coded caps do not add cumulative indicia to the bottle caps, in addition to pre-existing indicia, such as brand name logos, on the bottle caps. Rather, the only additional indicia are the variety of distinct colors upon the collection of bottle caps. The beverage bottles are unchanged and unencumbered by the present invention.

Only the bottle caps are changed, and these bottle caps are only changed by the addition of a respective distinct color or other indicia to each bottle cap.

The coded beverage cap system is used with, and in combination with, a plurality of comestible liquid-containing containers with removable, factory installed sealed caps. The plurality of coded caps are adapted to replace the removable, factory installed sealed caps.

Each of the coded caps has an appearance clearly distinguishing each coded cap from all of the other coded caps. For example, each coded cap is coded by a distinguishing color or distinguishing indicia, such as graphic patterns, fanciful symbols or the like.

In a further embodiment, the color coded bottle caps are sold as a retrofit kit for a social gathering, where the host or hostess can twist-off the original brand name bottle caps and twist on color coded replacement bottle caps for the guests of the social gathering.

The retrofit kit can also be used for a collection of sport drink bottles at an athletic team sporting event, where the liquid contents of the bottles are identical, but members of the athletic team need to identify their own sports drink bottle.

Although the collection of bottles have identical beverage liquids therein, the bottles therefore have different caps of a plurality of colored indicia indicative of each different user of each drinker of the liquid contents of each beverage bottle.

Each of the bottle caps are color coated or molded in different colors to differentiate the user of the liquids therein, such as bottled plain drinking water, flavored water, carbonated beverages, alcoholic and non-alcoholic beverages. The caps have internal threads, which engage and fit the conventional narrow neck threaded necks of beverage bottles.

In one embodiment, the present invention provides a collection of beverage bottle caps having permanent passive non-verbal temporarily cumulative indicia thereon. The beverage bottle caps bear a single unadorned colored surface selectively indicating the identity of a user of an unencumbered beverage bottle of a collection of beverage bottles, each having identical liquid contents therein. The coded caps are adapted to replace removable, factory installed sealed caps on the beverage bottles, whereby the user is able to identify any such beverage bottle partially consumed by the user.

In a further alternate embodiment, the collection of comestible containing liquid containers having removable, factory installed sealed caps, are coded with the distinguishing indicia, thereby permitting a user of each particular container, to clearly identify the container, from which the user previously drank a portion of the contents of the container.

For example, a user selects a factory sealed container and removes the cap therefrom. Then the user drinks a portion of the comestible liquid within the container. The user reseals the container with a coded replacement cap, which is clearly distinguishable from all other coded replacement caps made available to the user, thereby clearly identifying the container as one, which was partially consumed, by the user.

Color or other distinguishing indicia as aforesaid codes the coded caps. The user then places the container with the coded cap back among the other containers or elsewhere, with confidence that the user can retrieve his or her own beverage container at a later time.

Later, the user can retrieve the container at a later time by selecting his or her container having the coded cap which the user has identified as his or her own.

BRIEF DESCRIPTION OF THE DRAWINGS

The present invention can best be understood in conjunction with the accompanying drawings, in which.

DETAILED DESCRIPTION OF THE INVENTION

Figure 1:
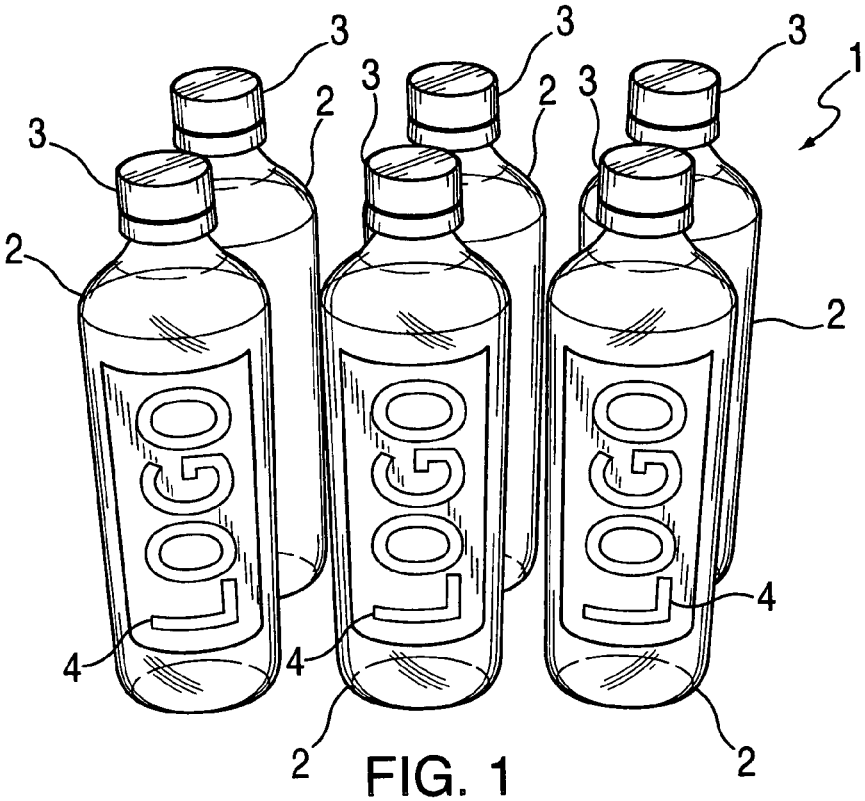
FIG. 1 (PRIOR ART)
FIG. 1 is a perspective view of a prior art collection of beverage bottles having bottle caps.

FIG. 1 is a perspective view of a prior art collection 1 of beverage bottles 2 having identical logos 4 thereon. In certain brands of beverages, however, bottles 12 may be devoid of any pre-existing logo indicia, such as logo indicia 4. In that case, bottles 2 are made of clear, transparent plastic. Identical bottle caps 3 close bottles 12.

Most standard beverage bottles, whether they be for 8 ounce, 12 ounce, 16 ounce, 20 ounce, one liter or two liters quantity of beverages, have bottle caps of about one inch (25 mm) in diameter, with top openings of about 0.875 inches (22 mm) in diameter, extending between a circumferential wall of about 1.5 mm in thickness all around.

Therefore bottle caps 3 are generally of a standard size, and are interchangeable with replacement bottle caps. Certain bottles of beverage brands such as GATORADE sports drinks or FRUIT2O flavored water have wide openings for drinking more water or beverage per unit of time. These wide bottles (not shown) can also be fitted with wider replacement bottle caps of the present invention.

Figure 2:
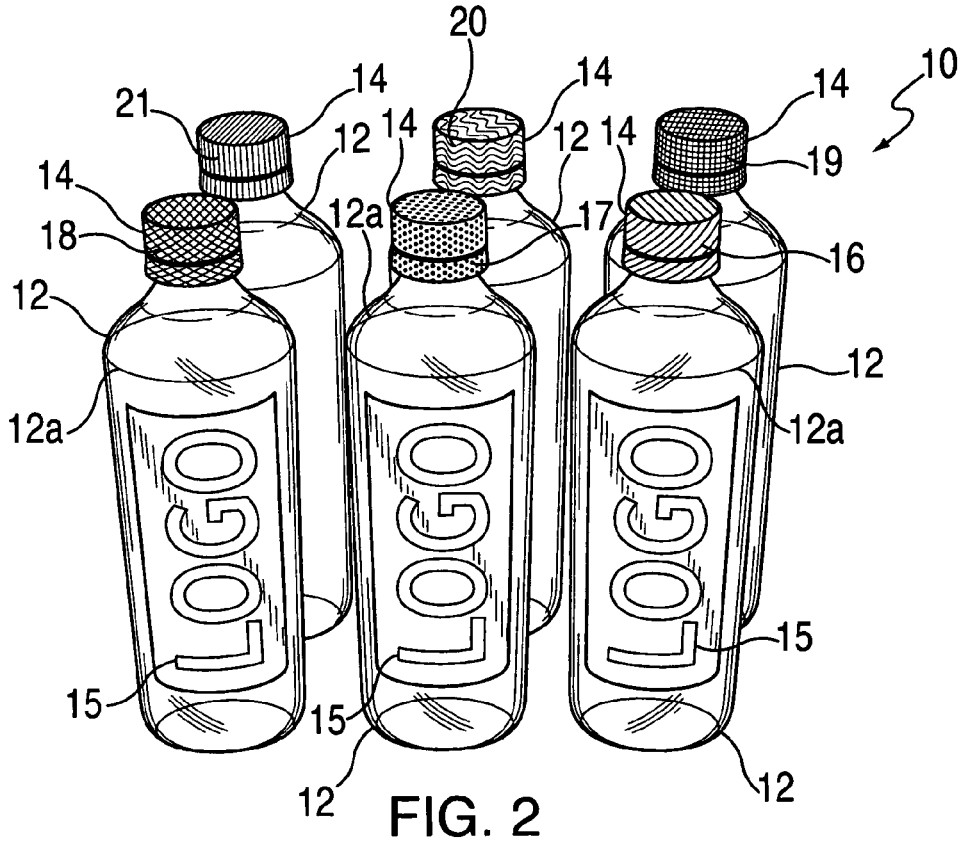
FIG. 2 is a perspective view of a collection of beverage bottles having bottle caps, each bottle cap with an unobtrusive indicia color coated on or molded therein.
Figure 8:
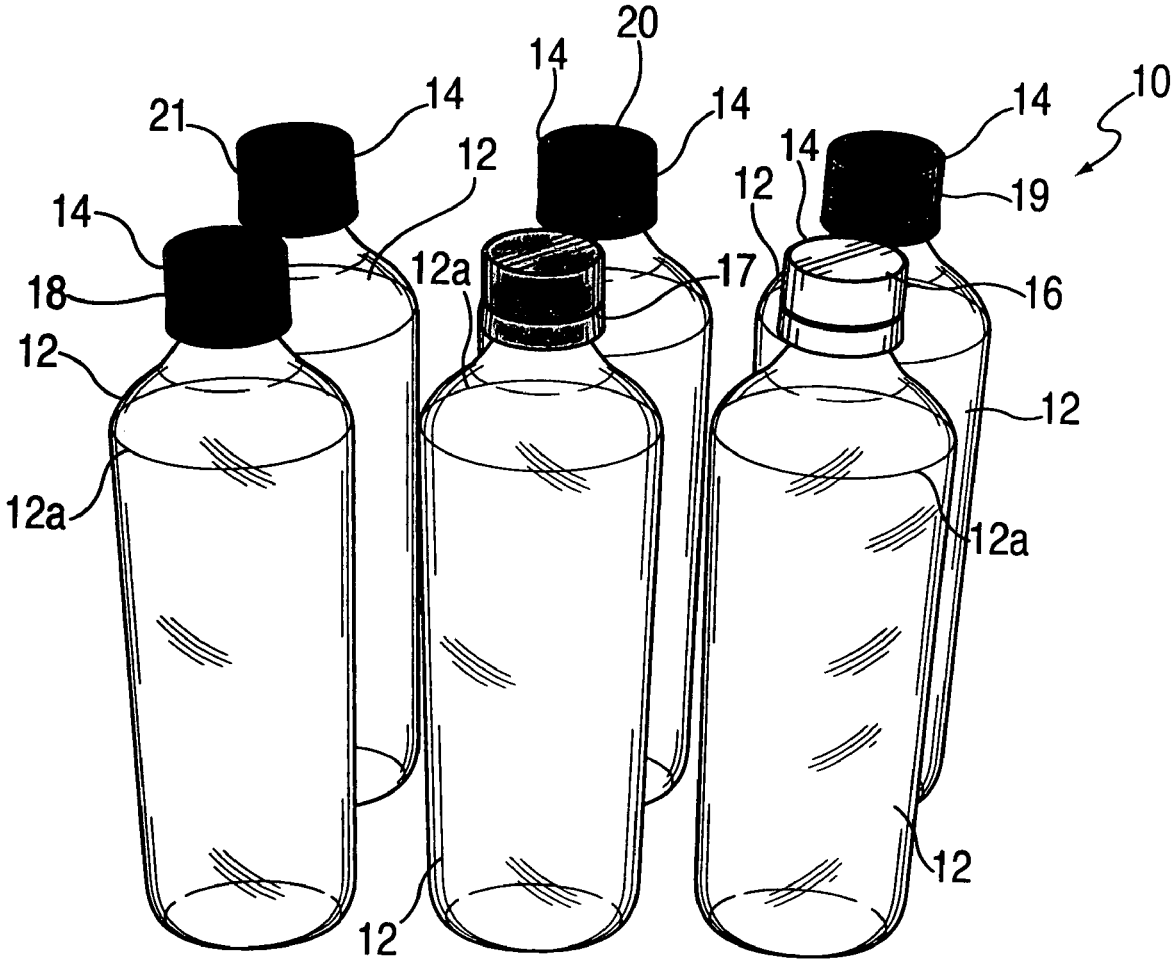

In connection with the present invention, FIG. 2 is a perspective view of a collection 10 of beverage bottles 12 having identical logos 15 thereon. In certain brands of beverages, however, bottles 12 may be devoid of any pre-existing logo indicia, such as logo indicia 15. In that case, as shown in FIG. 8, bottles 312 are made of clear, transparent plastic. Colored bottle caps 334 close bottles 312.

FIG. 2 shows a collection 10 of beverage bottles 12 having bottle caps 14, wherein each bottle cap 14 bears an unobtrusive indicia 16, 17, 18, 19, 20, 21, etc., such as a distinct color, which is coated on or molded therein. Each coded indicia 16, 17, 18, 19, 20, 21, etc. upon respective bottle caps 14 is indicative of each drinking user of each respective bottle 12 of the collection 10 of beverage bottles 12. The coded indicia 16, 17, 18, 19, 20, 21 are permanent and non-removable. The coded passive indicia 16, 17, 18, 19, 20, 21 do not encumber the surface of each bottle 12 bearing the bottle caps 14. Preferably non-verbal, the indicia 16, 17, 18, 19, 20, 21 are cumulative indicia, such as a distinct translucent or transparent color, which allows the user to read any pre-existing brand name advertising information through the indicia 16, 17, 18, 19, 20, 21 on each of the bottle caps 14. Also preferably, the indicia 16, 17, 18, 19, 20, 21 are single unadorned colored surfaces selectably indicating the identity of the respective users of unencumbered beverage bottles 12, of the collection 10 of beverage bottles 12, wherein each bottle 12 has the identical liquid contents 12*a* therein, such as bottled water.

FIG. 2 shows that the sides of the beverage bottles 12 are unencumbered by any tangible indicia, such as annular rings, decals, removable stick-on labels, lids, etc. and that only the bottle caps 14 have permanent passive, unobtrusive color-coded indicia 16, 17, 18, 19, 20, 21 for indicating each drinking user of each beverage bottle 12.

Figure 3:
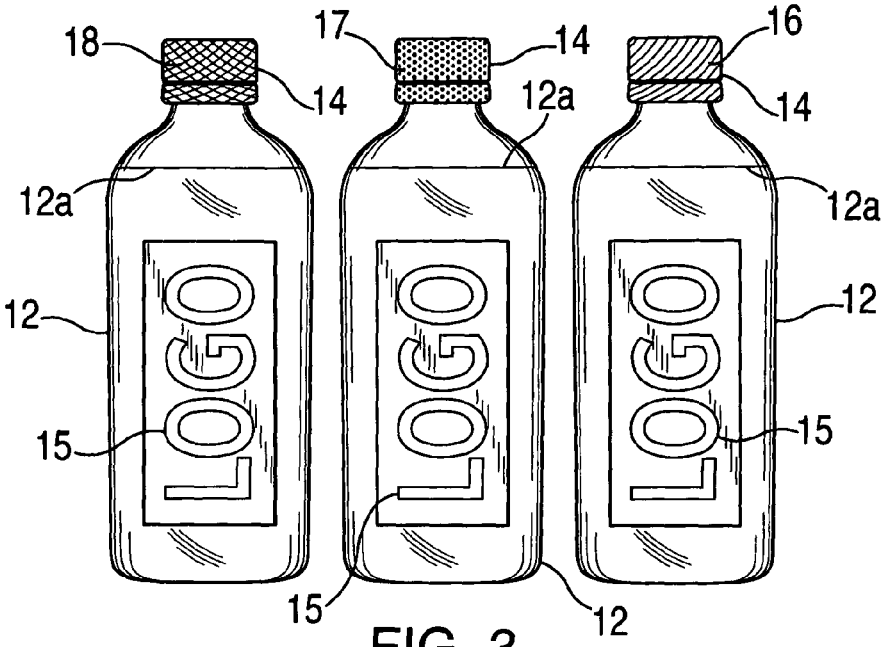
FIG. 3 is a side view thereof.

FIG. 3 shows a close-up view of a bottle cap having color-coded indicia.

Figure 4:
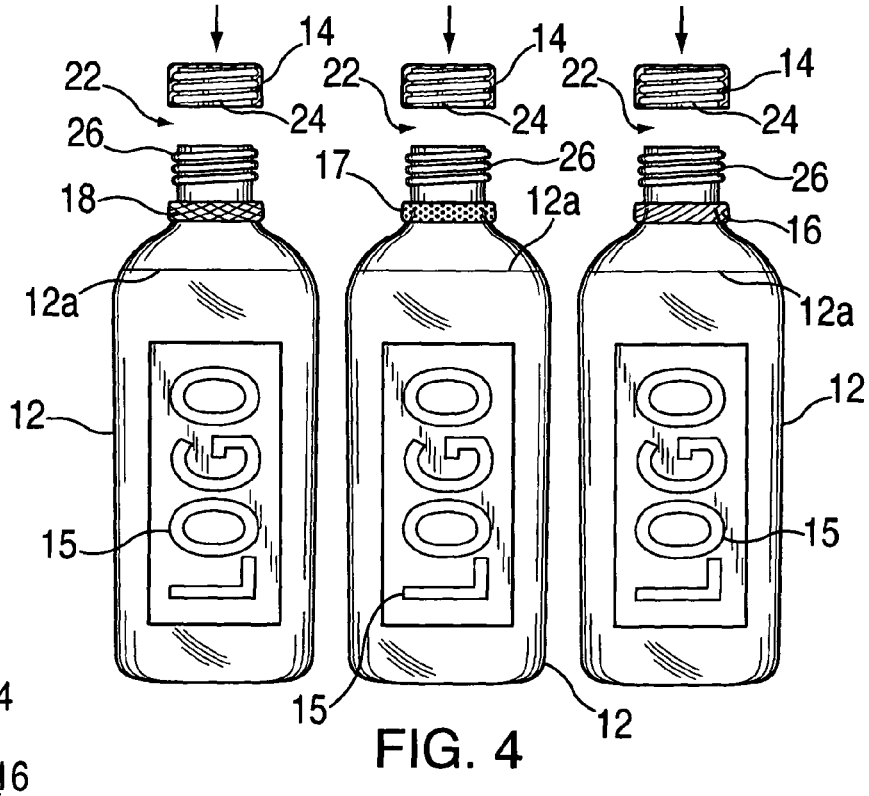
FIG. 4 is an exploded partial cutaway view thereof; showing a threaded attachment method.

FIG. 4 shows the conventional threaded attachment 22 of the inner threads 24 of each bottle cap 14 to the outer neck threads 26 of each bottle 12, which attachment 22 is unchanged and not interfered with by the color-coded indicia 16, 17, 18, 19, 20, 21 of the present invention, which are passively deposited upon the bottle caps 14 of the collection of beverage bottles 12.

Figure 5:
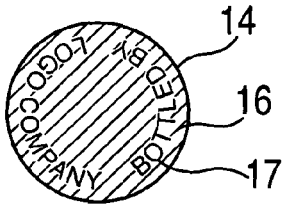
FIG. 5 is a close-up detail top plan view of a typical cap of the collection of caps of the present invention, with a logo visible through the indicia.

FIG. 5 is a close-up detail view of a typical bottle cap 14 of the collection 10 of bottle caps 14 of the present invention, with a brand name logo 17 visible through the indicia 16.

Figure 6:
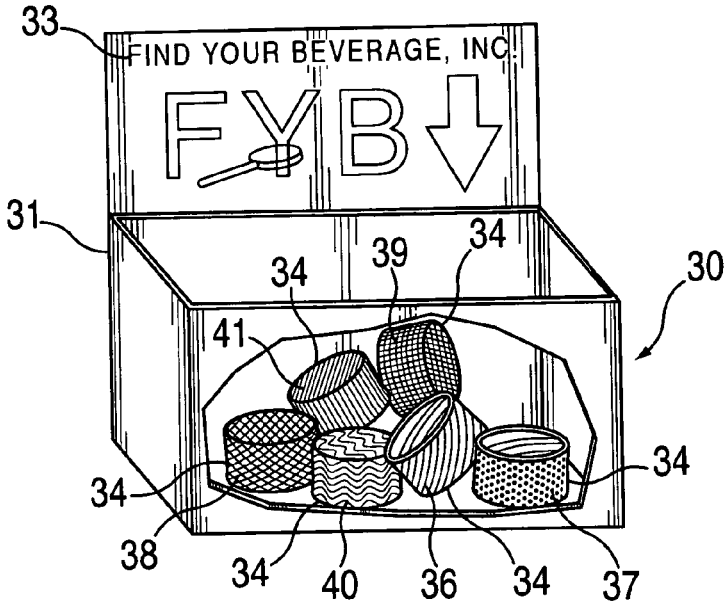
FIG. 6 is a perspective view of an alternate embodiment of a collection of color-coded bottle caps to be retrofitted onto conventional beverage bottles.

FIG. 6 is a perspective view of an alternate embodiment of a collection 30 of color-coded bottle caps 34 within a package 31 having instructional indicia 33 thereon, which explains to the consumer user that the color-coded bottle caps 34 are to be retrofitted onto conventional beverage bottles 12. The bottle caps 34 have threaded means thereon for mutual attachment therebetween to for attaching the respective bottle caps 34 to the liquid dispensing bottles 12 in an axial linear arrangement.

This assembly method shown in FIG. 6, of having color coded bottle caps 34 replace factory installed caps, is preferred because it is simple to manufacture, insures surface alignment, affords quick snap-fit assembly, and does not involve the use of adhesives possibly leaving a residue on the outer surfaces of the bottles.

The coded caps 34 of FIG. 6 are adapted to replace removable, factory installed sealed caps 14 on the beverage bottles 12, whereby the user is able to identify any such beverage bottle 12 partially consumed by the user.

In FIG. 6, the collection of comestible containing liquid containers, such as bottles 2 shown in prior art FIG. 1, have removable, factory installed sealed identical bottle caps 3. But, according to the present invention, conventional identical bottle caps 3 can be replaced by coded replacement bottle caps 34 with the distinguishing indicia 36, 37, 38, 39, 40 and 41, thereby permitting a user of each particular container, such as bottle 12, to clearly identify the container, from which the user previously drank a portion of the contents of the container.

For example, a user selects a factory sealed container bottle 12 and removes the cap 14 therefrom. Then the user drinks a portion of the comestible liquid 12*a* within the container bottle 12. The user reseals the container bottle 12 with a coded replacement cap 34, which is clearly distinguishable from all other coded replacement caps 34 made available to the user, because of distinguishing indicia 36, 37, 38, 39, 40 and 41 thereby clearly identifying the container bottle 12 as one which was partially consumed by the user. The coded caps 34 are coded by color or other distinguishing indicia 36, 37, 38, 39, 40 and 41 as aforesaid.

Figure 7:
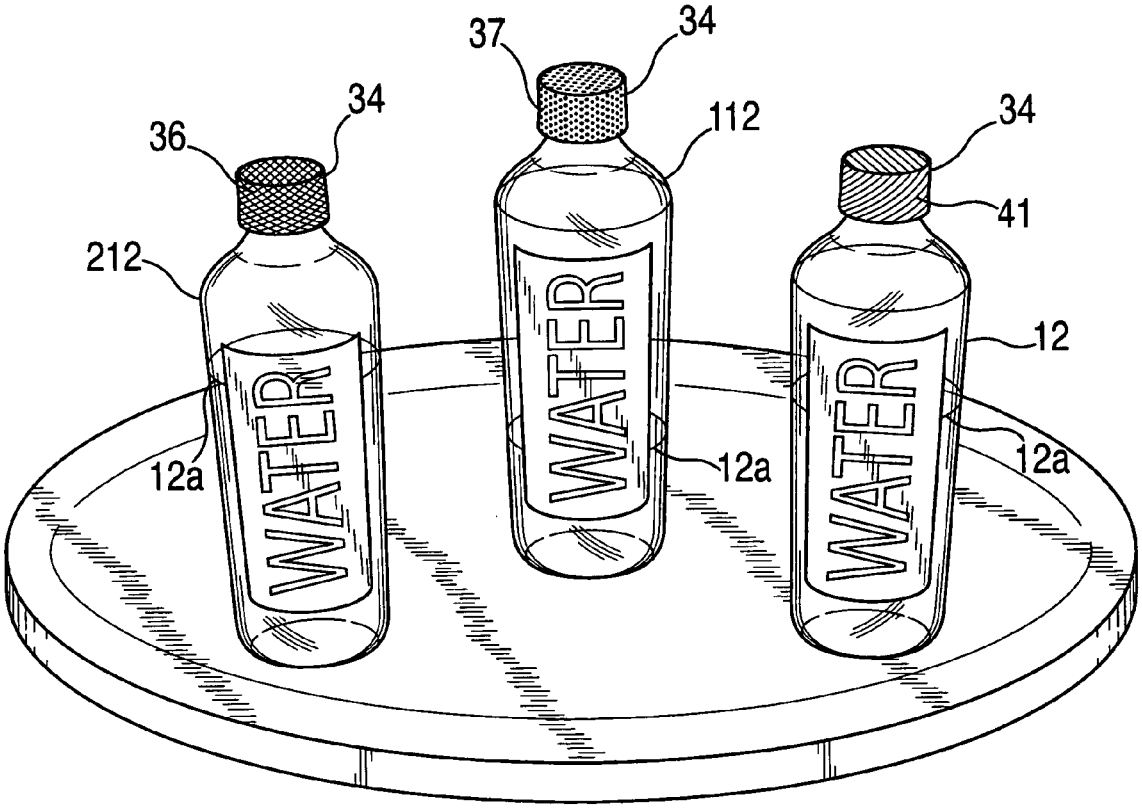
FIG. 7 shows three randomly placed bottles with the retrofitted bottle caps of the alternate embodiment of FIG. 6, placed in the vicinity of each other upon a table; and, FIG. 8 is a color rendition of a further collection of bottles and caps in accordance with the present invention.

As shown in FIG. 7, the user then places the container 12 with the coded cap 14 back among the other container bottles 12 or elsewhere, with confidence that the user can retrieve his or her own beverage container bottle 12 with fluid 12*a* at a later time. Later, the user can retrieve the container 12 at a later time by selecting his or her container bottle 12 having the coded cap 34 which the user has identified as his or her own. Coded cap 34 distinguishes the user's bottle 12 from other container bottles 112 or 212 bearing other bottle caps 34 with different indicia 36 or 37 thereon.

There is no need for a separate tangible cap to bear the identifying indicia, such as a retrofit lid, tab or annular collar. Also, the fit-together bottle caps are each coated or molded with a different color or indicia to differentiate the drinking users of the bottles.

The bottle caps 34 are intimate contact with the bottles 12 without the surface of the bottles 12 being modified or interrupted by collars, tabs, additional imprinted indicia, adhesives or lids at their outer surfaces.

For illustrative purposes, FIG. 8 is a color rendition of a further collection of bottles 312 and caps 334 in accordance with the present invention. In FIG. 8, the bottles 312 are devoid of any pre-existing logos. FIG. 8 shows the bottle caps 334 bearing the colors blue, orange, yellow, red, green and black. These colors are illustrative only, as it is assumed that any variety of colors may be chosen as indicia for bottle caps 334, as long as no two colors are the same.

It is further noted that other modifications may be made to the present invention without departing from the scope thereof, as noted in the appended claims.

I claim:

1. A coded container system for use with and in combination with a plurality of containers having contents of a single identical beverage therein and for identifying which of a plurality of users that the plurality of containers are associated with, each of the containers having a neck, consisting of:

each said container of said plurality of containers each having identical contents of a single identical beverage associated with a set of identical contents of a single identical beverage contained within each respective container of said plurality of containers;

a collection of plurality of user-removable color-coded caps, with each colored cap comprising a different color and each different color of the collection of plurality of colored caps corresponding to a user's personal identification of a plurality of users; each respective user imbibing a respective identical content of said set of identical contents of a single identical beverage contained within each respective container of said collection of said plurality of containers;

each respective colored cap being threadably and removably securable on a respective user's container via threadable engagement over the threaded neck about the opening of the respective container, each said colored cap being adapted to retrofit about the necks of all of the plurality of containers and maintain the respective identical contents of a single identical beverage therein, each respective cap of the collection of user-removable color coded caps comprising a different color of a plurality of colors, each colored cap of the collection of user-removable differently colored coded caps associated with a respective personal identification of a different user of the plurality of users each imbibing a respective content of said set of identical contents of a single identical beverage within all of said containers, each said colored cap not referring to a different contents of a single identical beverage associated with each color of said collection of colored caps;

each said user-removable color-coded cap bearing only a color associated with each said personal identification of said different users on all of each respective exterior surface of each cap of said collection of caps;

said collection of plurality of user-removable color-coded caps being provided with instructions informing the plurality of users that a single differently color coded cap of said collection of said user-removable differently color coded caps may be retrofit and inserted over and used by a single user of the plurality of users to identify which of each of the collection of containers having identical contents of a single identical beverage therein are associated with each said different personal identification of each user of the plurality of users each imbibing a respective content of only one respective container of said set of identical contents of a single identical beverage within said containers.

* * * * *